US005298923A

United States Patent [19]

Tokunaga et al.

[11] Patent Number: 5,298,923

[45] Date of Patent: Mar. 29, 1994

[54] INK JET MISDISCHARGE RECOVERY BY SIMULTANEOUSLY DRIVING AN INK JET HEAD AND EXHAUSTING INK THEREFROM

[75] Inventors: Tatsuyuki Tokunaga; Jiro Moriyama, both of Yokohama, Japan

[73] Assignee: Canon Kabushiki Kaisha, Tokyo, Japan

[21] Appl. No.: 727,284

[22] Filed: Jul. 5, 1991

Related U.S. Application Data

[63] Continuation of Ser. No. 501,351, Mar. 28, 1990, abandoned, which is a continuation of Ser. No. 198,733, May 25, 1988, abandoned.

[30] Foreign Application Priority Data

May 27, 1987 [JP] Japan ..... 62-130578
May 27, 1987 [JP] Japan ..... 62-130579

[51] Int. Cl.[5] ..... B41J 2/165
[52] U.S. Cl. ..... 346/1.1; 346/140 R
[58] Field of Search ..... 346/1.1, 140 R

[56] References Cited

U.S. PATENT DOCUMENTS 4,045,802 8/1977 Fukazawa et al. ..... 346/140 R
4,123,761 10/1978 Kimura et al. ..... 346/140 R
4,176,363 11/1979 Kasahara ..... 346/140 R
4,245,224 1/1981 Isayama ..... 346/140 X
4,466,005 8/1984 Yoshimura ..... 346/140
4,551,735 11/1985 Suzuki et al. ..... 346/140 R
4,600,931 7/1986 Terasawa ..... 346/140 R
4,609,925 9/1986 Nozu et al. ..... 346/1.1
4,692,777 9/1987 Hasumi ..... 346/140
4,791,437 12/1988 Accattino ..... 346/140

OTHER PUBLICATIONS

Resonant Disintegration of Bubbles; IBM TDB, V28, N2, Jul. 1985, p. 630.

*Primary Examiner*—Joseph W. Hartary
*Attorney, Agent, or Firm*—Fitzpatrick, Cella, Harper & Scinto

[57] ABSTRACT

A method is used for recovering misdischarge of liquid in an on-demand type liquid jet recording apparatus. The apparatus comprises a recording head having a discharge port for discharging liquid, a liquid path communicating with the discharge port and energy generating means provided in response to the liquid path so as to generate energy utilized for discharging liquid, and exhausting means for exhausting liquid in the liquid path. Drive of the energy generating means is performed in synchronism with drive of the exhaust means at least in a predetermined time period.

29 Claims, 11 Drawing Sheets

INK JET MISDISCHARGE RECOVERY BY SIMULTANEOUSLY DRIVING AN INK JET HEAD AND EXHAUSTING INK THEREFROM

This application is a continuation-in-part of application Ser. No. 07/501,351 filed Mar. 28, 1990, now abandoned, which is a continuation of application Ser. No. 07/198,733 filed May 25, 1988, now abandoned.

BACKGROUND OF THE INVENTION

1. Field of the Invention

The present invention relates to a method for recovering misdischarge is an ink jet recorder which eliminates non-discharge or misdischarge of ink to permit stable discharge of ink, and an ink jet recording apparatus using the same.

2. Related Background Art

In a prior art ink jet recorder such as that disclosed in U.S. Pat. No. 4,045,802, capping means for closing a periphery of an discharge orifice of a record head is provided to close the periphery in a non-record mode so that the record head is isolated from surrounding atmosphere while the record head is capped, and air layer in the capping means is filled with vapor of ink to keep a saturated vapor pressure so that drying and increase of viscosity of the ink in the discharge orifice are prevented.

However, in such a recorder, in a low humidity environment or when recording is paused for a long time it is not possible to sufficiently prevent the increase of viscosity of ink even if drying is prevented by the capping means, and hence it is difficult to completely prevent non-discharge or misdischarge of the ink from the nozzle in a record mode.

When a fine air bubble or dust is present in the ink in the discharge orifice, it causes disturbance of discharge of the ink in the record mode and it significantly deteriorates an image quality.

In order to solve such a problem, U.S. Pat. No. 4,600,931 discloses an ink jet recorder which renders the air layer in the capping means to be of low pressure so that the ink in the discharge orifice of the record head is sucked. U.S. Pat. No. 4,123,761 disclosed an ink jet recorder which has pumping means for an ink supply system including the record head and it is automatically or manually activated to pressurize the ink so that the ink is discharged from all nozzles of the record head. U.S. Pat. No. 4,176,363 discloses an ink jet recorder which effects pre-discharge in order to prevent non-discharge of the ink.

However, even such ink jet recorders are not always sufficient in that the recorders are always operable in a best condition regardless of a surrounding environment or recording condition. It is particularly difficult to completely eliminate fine air bubbles in the ink. Even if there is no fine air bubble at the start of recording, fine air bubbles may be generated and grown by cavitation during continuous recording operation, or ink droplets including air bubbles therein may be discharged from the discharge orifice to cause disturbance in the discharge of the ink.

SUMMARY OF THE INVENTION

It is an object of the present invention to provide a method for recovering misdischarge in an ink jet recording apparatus which allows recording at a best condition in any circumstance.

It is another object of the present invention to provide an ink jet recording apparatus which can remove air bubbles of any size with a simple construction and enable high quality recording.

Still another object of the invention is to provide an ink jet recording apparatus comprising a recording head having energy generating means for generating energy to be used to discharge ink, exhaust means for exhausting ink in said recording head; drive means for applying a drive signal to said energy generating means to drive said recording head in response to the drive of said exhausting means and means for varying the drive signal applied to said energy generating means in response to the drive of said exhausting means.

Still another object of the invention is to provide a method for recovering misdischarge of liquid in an on-demand type liquid jet recording apparatus, said apparatus comprising a recording head having a discharge port for discharging liquid, a liquid path communicating with said discharge port and energy generating means provided in response to said liquid path so as to generate energy utilized for discharging liquid and exhausting means for exhausting liquid in said liquid path, wherein drive of said energy generating means is performed in synchronism with drive of said exhaust means at least in a predetermined time period.

Still another object of the invention is to provide a method for recovering misdischarge of liquid in a liquid jet recording apparatus, said apparatus comprising a recording head having a discharge port for discharging liquid, a liquid path communicating with said discharge port and energy generating member provided in response to said liquid path so as to generate energy utilized for discharging liquid and suction means for sucking liquid from said discharge port, wherein said recording head is driven by changing a signal to be applied to said energy generating means in response to drive of said suction means.

Still another object of the invention is to provide a ink jet recording apparatus comprising a recording head having a discharge port for discharging ink, a liquid path communicating with said discharge port and energy generating means provided in response to said liquid path so as to generate energy utilized for discharging liquid, driving means for driving said recording head, exhausting means for exhausting liquid in said liquid path during non-operation period, and detecting means for detecting drive of said exhausting means, wherein said driving means is driven by a detection signal of said detecting means.

DETAILED DESCRIPTION OF THE PREFERRED EMBODIMENTS

Embodiment 1

Figure 1:
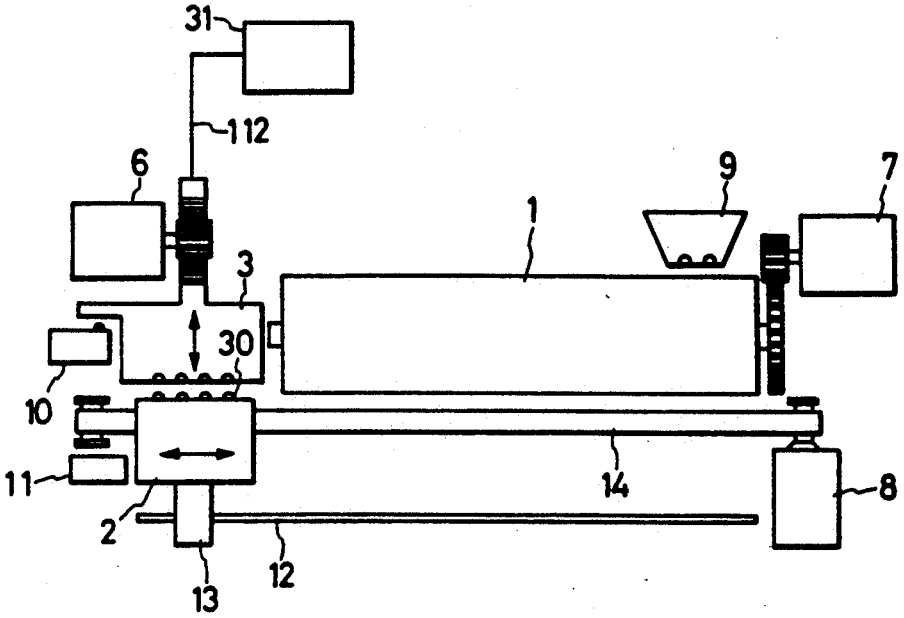
FIG. 1 shows a schematic view of an ink jet recording apparatus of the present invention.

FIG. 1 shows a schematic top view of an ink jet recording apparatus of the present invention.

In FIG. 1, numeral 1 denotes a platen which is rotated by a line feed motor 7 which is a pulse motor to feed a record sheet (not shown). The presence or absence of the record sheet is detected by a sheet sensor 9. Numeral 2 denotes an ink jet recording head which has a plurality discharge ports 30 through which ink is to be discharged. It is mounted on a carriage which is slidable on a guide bar (not shown) and movable along the platen 1 by drive by a carriage motor 8 which is a DC motor, through a belt 14. In order to detect the position of the recording head 2, a linear encoder 12 and an encoder sensor 13 are provided, and in order to detect a home position, a home position sensor 11 is provided. In order to recover misdischarge of ink from the discharge ports 30 of the recording head 2, a cap 3 which is used to protect the discharge ports and to suck the ink and which is driven by an auto-cap motor 6 is provided. The operational position of the cap 3 is detected by a cap sensor 10.

The cap 3 is connected to a pump 31 through a tube 112 and the pump 31 can suck the ink from the nozzle by reducing a pressure.

Figure 2:
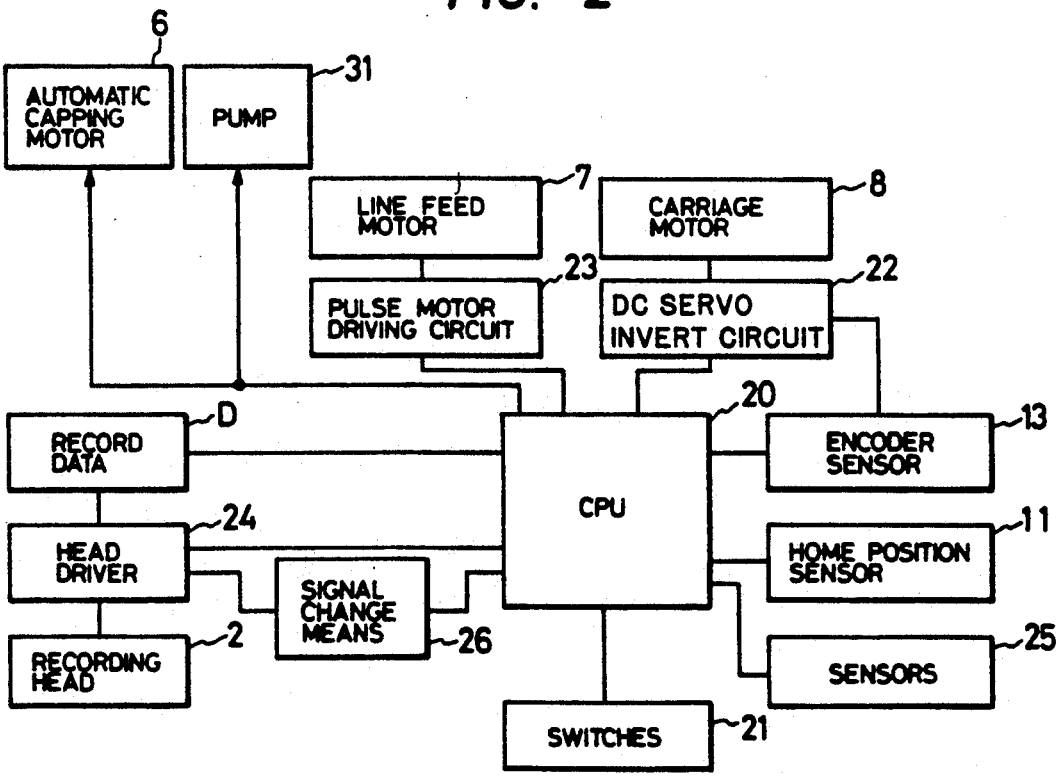
FIG. 2 shows a block diagram of a control unit of the ink jet recording apparatus of the present invention.

The ink jet recording apparatus thus constructed is controlled by a control unit shown in FIG. 2 which uses a known CPU 20. The CPU 20 operates in accordance with inputs entered by switches provided on a console panel (not shown). It refers the inputs from the encoder sensor 13 and the home position sensor 11, controls the drive of the carriage motor 8 through a DC servo reversible circuit 22, controls the drive of the line feed motor 7 through a pulse motor drive circuit 23, and supplies record data D to a head driver 24, which drives the recording head 2 to discharge the ink. It also controls other mechanisms (not shown) in accordance with inputs from other sensors 25.

When a print switch of the switches 21 is depressed, the record operation is started. After the presence of the record sheet has been detected by the sheet sensor 9, the line feed motor 7 is driven by several steps, the platen 1 is rotated and the record sheet is set to a start of record position. Then, the carriage motor 8 is driven to reciprocally move the recording head 2, and the line feed motor 7 is driven in synchronism therewith to feed the record sheet one line at a time. On the other hand, a drive signal (drive pulse) representing the record data is applied from the head driver 24 to energy generating means of the recording head 2 so that the recording head 2 is driven and the ink is discharged from the discharge ports 30 to record characters or image.

Figure 3:
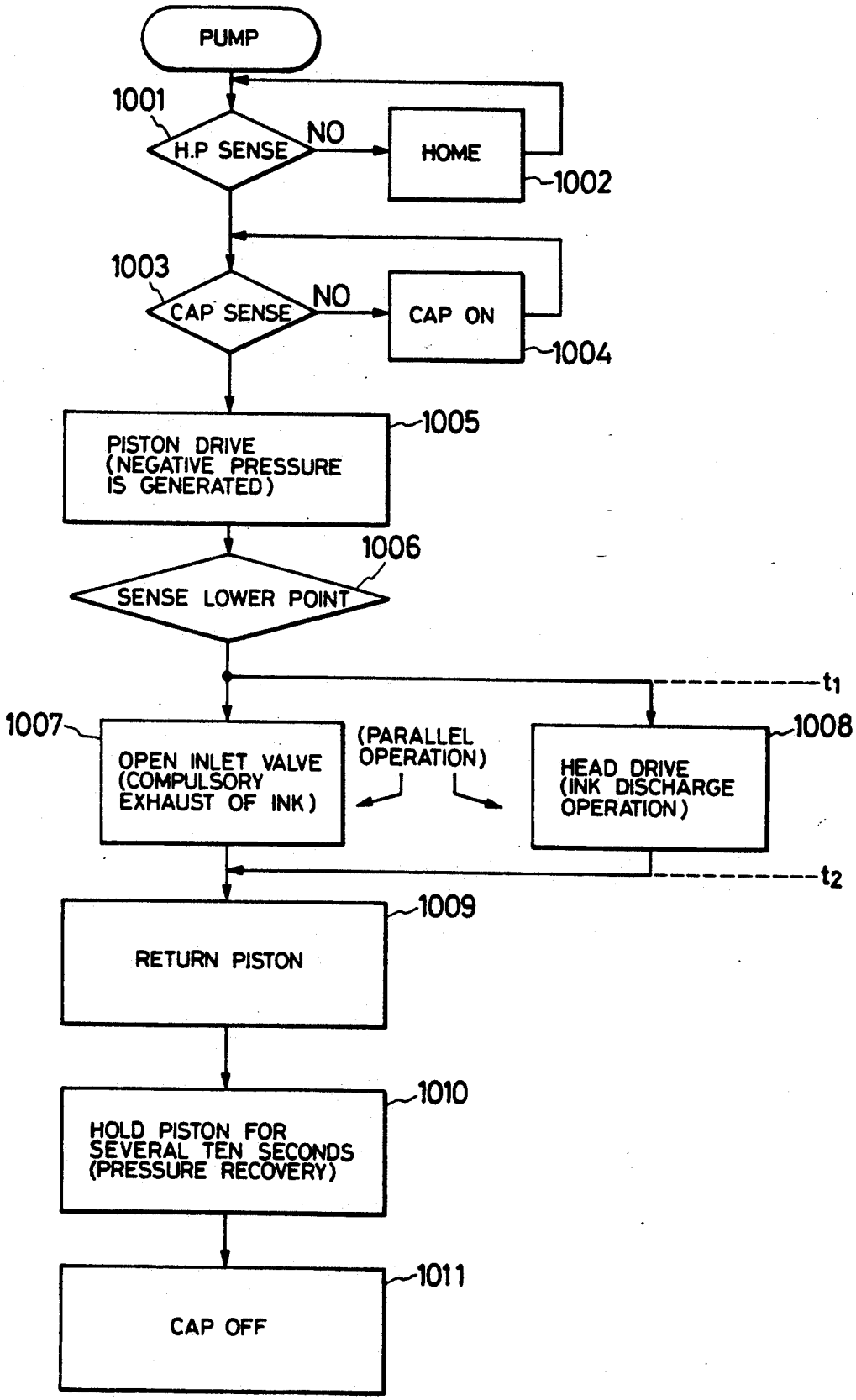
FIG. 3 shows a flow chart of a recovery operation of the present invention.
Figure 4:
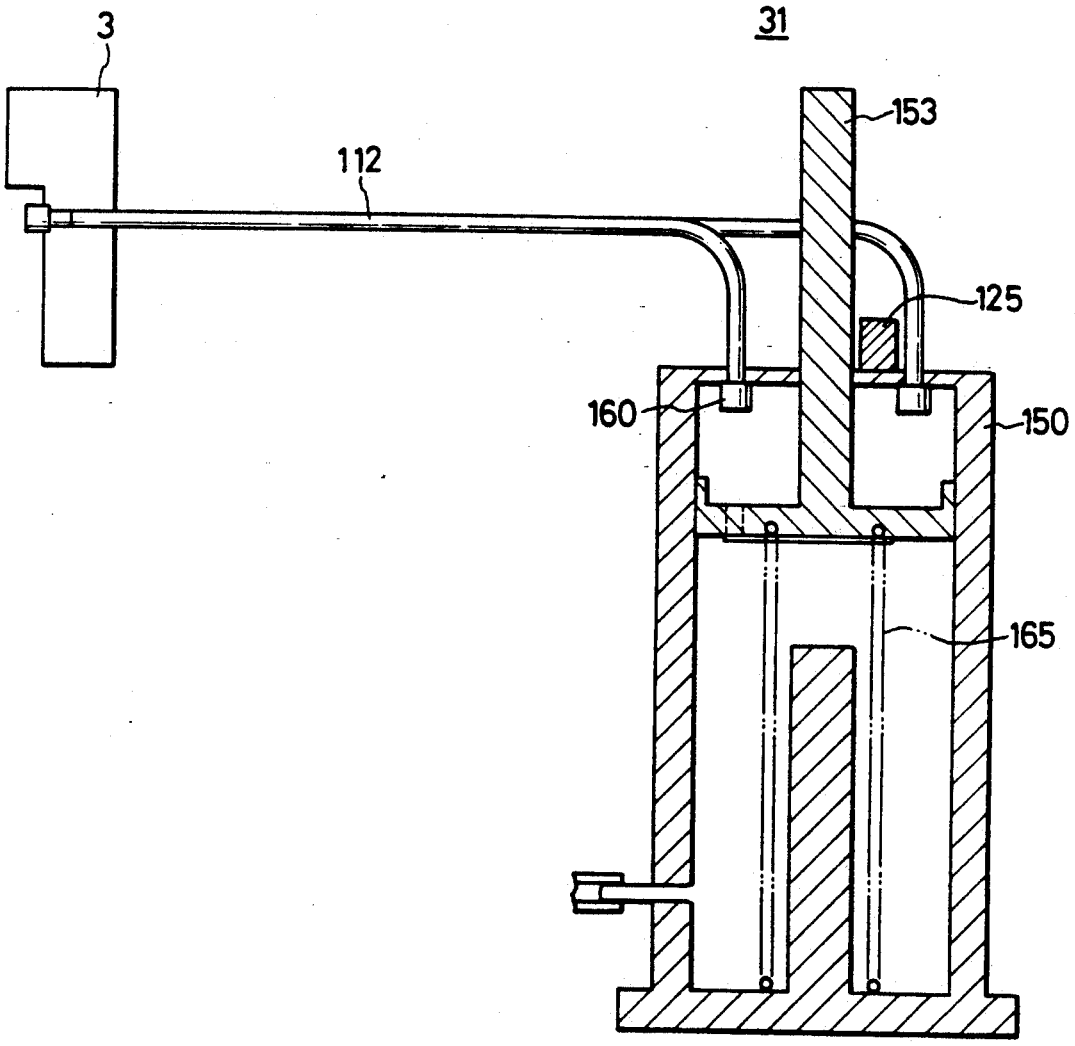
FIG. 4 shows a schematic sectional view of ink suction recovery means of the present invention.
Figure 5:
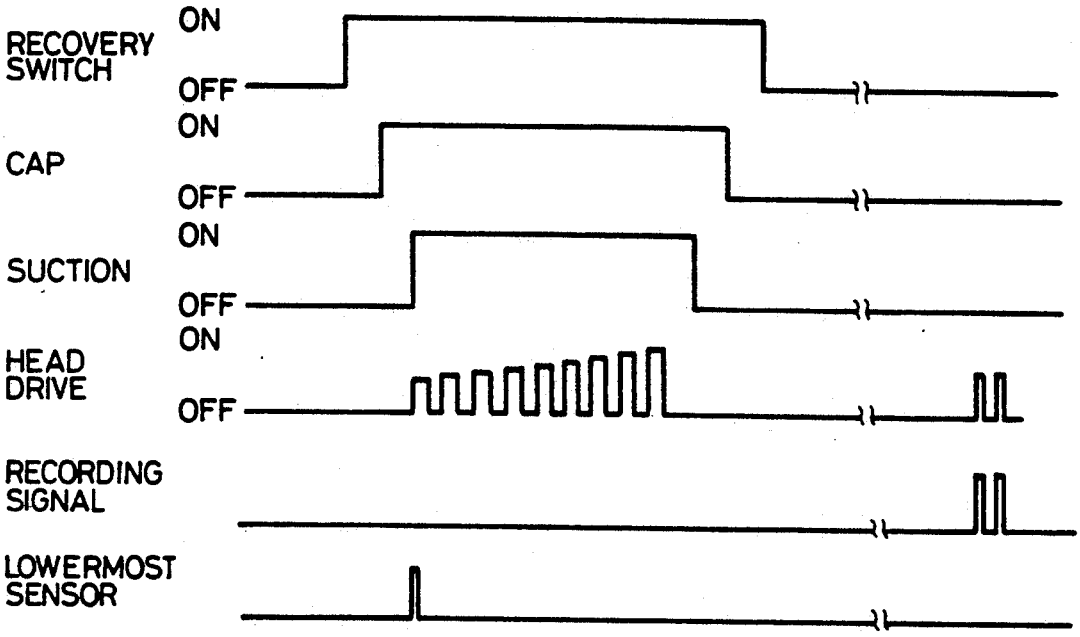
FIG. 5 shows a timing chart of the recovery operation of the present invention.

If the recording is not properly done due to misdischarge of the ink, a recovery switch of the switches 21 is depressed for recovery. FIG. 3 shows a flow chart thereof, and FIG. 4 shows a schematic sectional view of ink suction recovery means as ink exhausting means. FIG. 5 shows a timing chart of the drive of the pump and the recording head.

In a step 1001, the home position sensor 11 detects if the head 2 is at the home position. If it is not at the home position, the recording head 2 is returned to the home position by the carriage motor 8 (step 1002). In a step 1003, the cap sensor 10 detects if the discharge ports are capped, and if they are not capped, the auto-cap motor 6 is energized to cap the discharge ports (step 1004). In a step 1005, a piston 153 of the pump 31 is driven downward by a motor (not shown). As a result, a volume in a cylinder 150 above the piston increases and a negative pressure is generated. In a step 1006, a lowermost point sensor 125 provided on the suction pump detects that the piston reaches its bottom point, the motor is deenergized and a flow-in valve 160 is opened (step 1007). The negative pressure of the pump is applied to the ink in the liquid path of the ink jet recording head 2 through the tube 112, and the ink in the liquid path is sucked by the pump. As the ink is sucked, a signal is applied to the head driver in a step 1008 and the head is driven in a manner described below. As a result, the ink vibrates and fine air bubbles which deposit to an inner wall of the liquid path of the record head 2 and which are hardly removed merely by the suction pump are easily removed (FIG. 5).

In steps 1009 and 1010, the piston 153 is returned upward by a spring 165 so that the pressures in the pump and the cap are returned to their initial states. In a step 1101, the capping is released and the record operation is ready to start.

Figure 6:
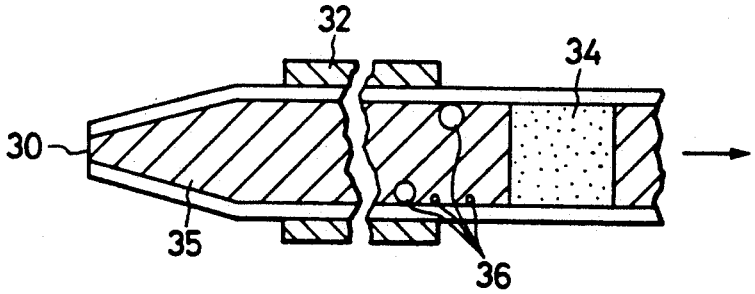
FIG. 6 shows a schematic sectional view illustrating air bubbles in a liquid path.

In the present embodiment, the diameter of the air bubbles 36 in the liquid path 35 of FIG. 6 is 10~500 μm. In FIG. 6, numeral 32 denotes a piezoelectric element which is electromechanical transducer means as energy generation means, and numeral 34 denotes a filter for removing foreign materials such as dust. In the present embodiment, the drive frequency of the recording head varies between 300 Hz and 10 KHz.

In the present embodiment, as shown in FIG. 2, signal varying means 26 for varying the drive signal (drive pulse) applied to the recording head when the ink is sucked from the discharge port. The signal varying means is driven on basis of a signal generated from sensor 125.

A voltage of the drive pulse is varied to change the drive force of the recording head by the pulse varying means 26.

Figure 7:
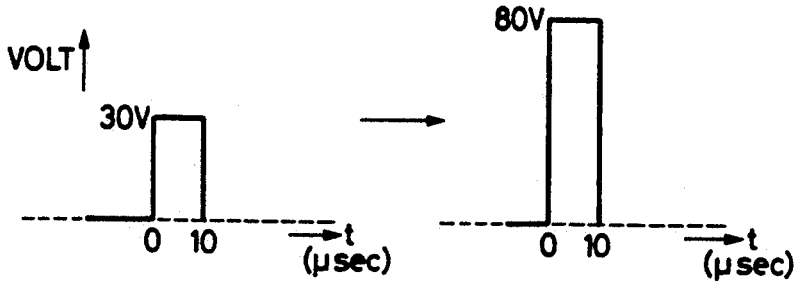
FIG. 7 shows a change in a record head drive pulse in the recovery operation in one embodiment of the present invention.
Figure 8:
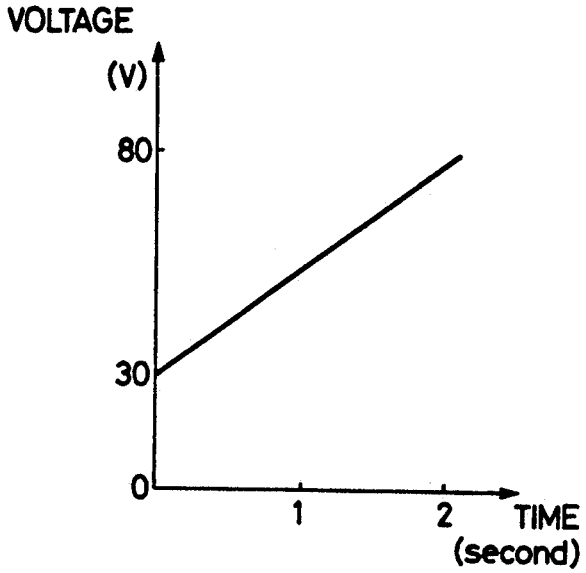
FIG. 8 shows a change in a record head drive voltage in the recovery operation in the one embodiment of the present invention.

As shown in FIGS. 7 and 8, the voltage of the drive pulse is continuously varied between 30 V and 80 V for two seconds at the driving frequency of 500 Hz as the ink is sucked from the discharge port.

In this manner, by driving the ink suction pump while the drive force of the recording head is varied, fine air bubbles which could not be removed merely by the suction pump are substantially perfectly removed.

Figure 9:
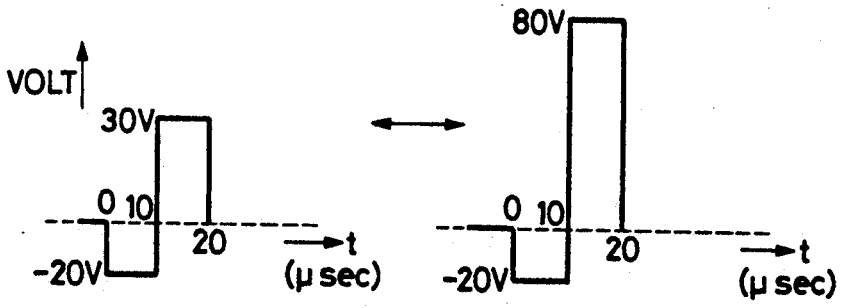
FIGS. 9, 10 and 11 show changes in the record head drive pulse in the recovery operation in the present invention.

FIG. 9 shows a modification of the drive pulse shown in FIG. 7. In the present modification, a pulse of the opposite polarity is applied prior to a pulse for pressurizing the ink.

Figure 10:
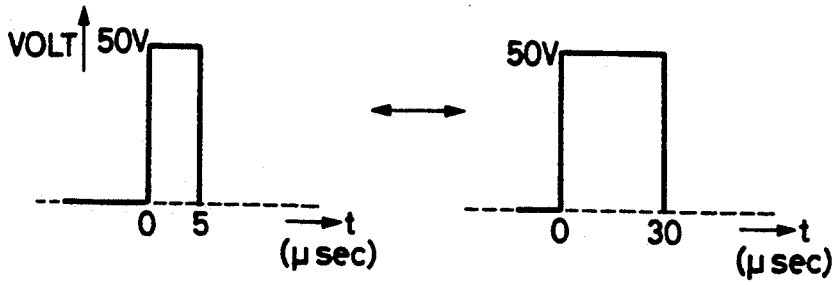
Figure 11:
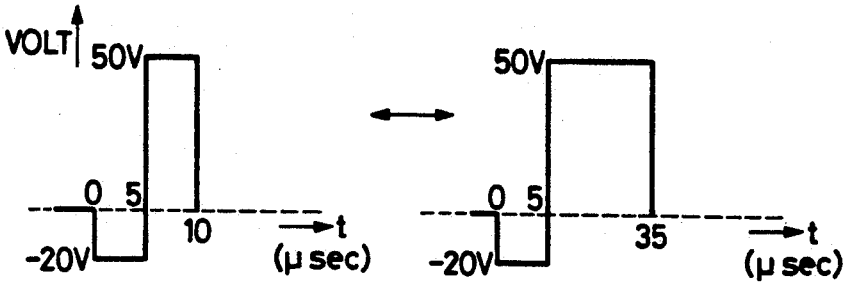
Figure 12:
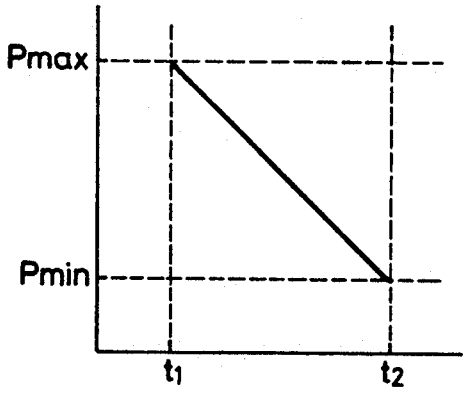
FIGS. 12, 13, 14, 15, 16, 17 and 18 show changes in a recording head drive force in the recovery operation in the present invention.
Figure 13:
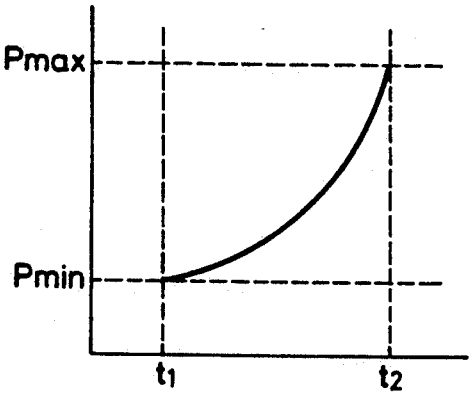
Figure 14:
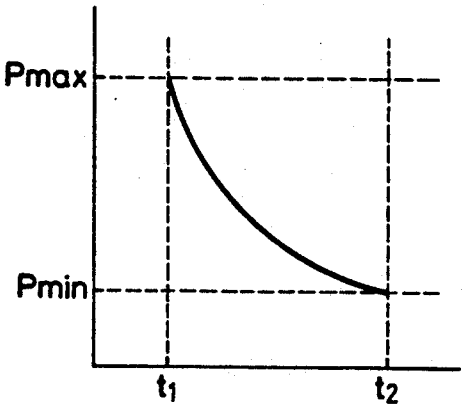
Figure 15:
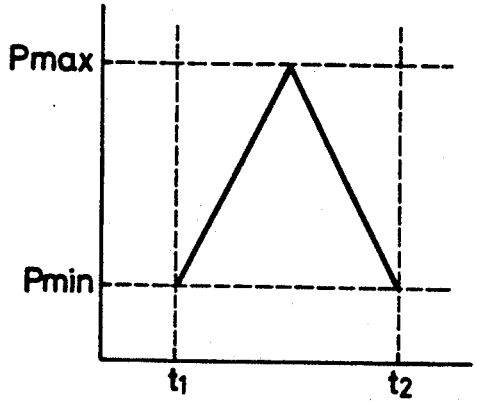
Figure 16:
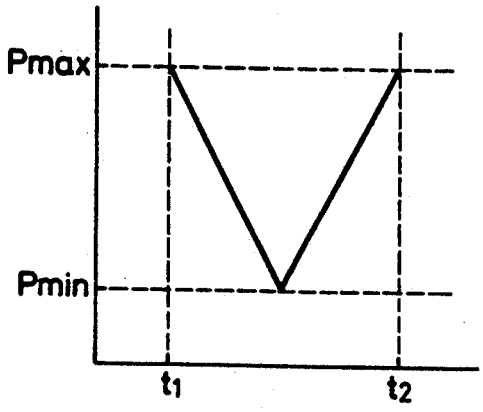
Figure 17:
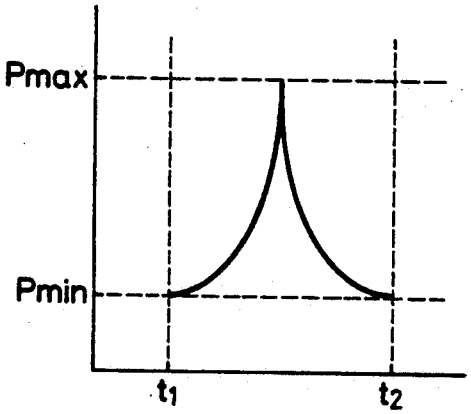
Figure 18:
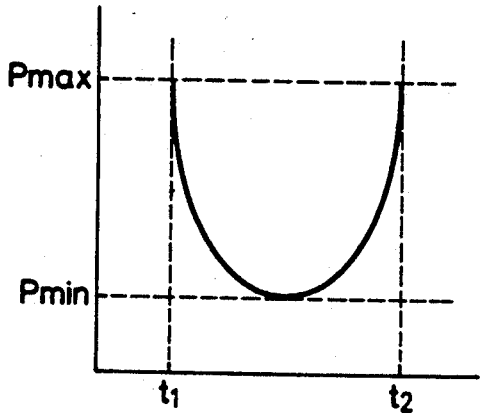

In FIGS. 7 and 9, the voltage of the drive pulse voltage is varied to change the drive force of the recording head. In FIGS. 10 and 11, a width of the pulse is varied by the signal varying means. In FIGS. 12, 13, 14, 15, 16, 17 and 18, the drive force of the recording head is varied in a predetermined time period timed with the suction through the discharge port. The time period $|t_2-t_1|$ during which the drive force is varied is preferably 0.5~3 seconds, while taking a lifetime of the energy generation member and a size of the liquid path in the record head into account. Power minimum (Pmin) indicates a minimum drive force to allow normal discharge of the ink, and power maximum (Pmax) indicates a maximum drive force to allow normal discharge of the ink.

In the present invention, the range of variation of the drive force of the recording head is preferably between Pmin and Pmax, as shown in FIGS. 8 and 12~18, while taking an effect to the energy generating means and an efficiency of removal of air bubbles into consideration, although other range of drive force may be used.

In the present embodiment, in order to vary the drive force of the record head in the range between Pmin and Pmax, the voltage of the drive pulse is changed in the range between 30 V and 80 V, or the pulse width is varied in the range between 5 μsec and 30 μsec.

In this manner, by repeatedly varying the drive force of the recording head once to several times and driving the ink suction pump to suck the ink from the discharge port, fine air bubbles which were left if only the suction pump wee used can be substantially perfectly removed. By varying the drive force of the record head, the displacement of the air bubbles in the liquid path varies. Thus, by varying the drive force of the record head simultaneously with the forcive discharge of the ink, air bubbles of any size can be discharged from the liquid path.

It should be noted that both the voltage and the width of the drive pulse may be varied.

Additionally, ink flow reaches its peak (maximum) and air bubbles are more effectively removed since drive timing of said recording head is in synchronism with application of entire negative pressure in the cylinder at a time.

The drive pulse is not limited to the square wave used in the embodiment but it may have a waveform having a fall time of 200~300 μsec during the last transition of the drive pulse.

In the present invention, the voltage of the drive pulse is defined by a peak value of the drive pulse, and the pulse width is defined by a pulse width at one half of the peak value.

Embodiment 2

In the present embodiment, when the ink is sucked from the discharge port by the signal varying means and in response to the signal of the lowermost sensor, the frequency of the drive signal (drive pulse) applied to the record head is varied.

Figure 19:
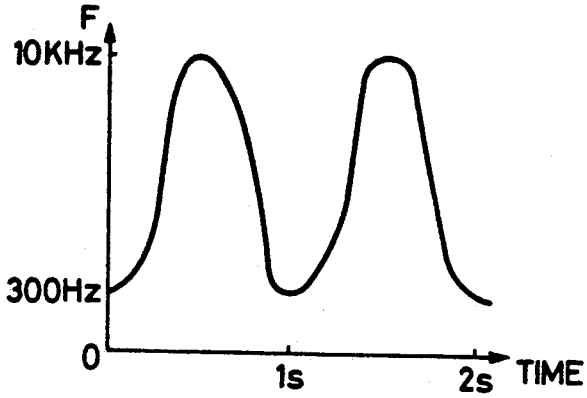
FIG. 19 shows a change in a recording head drive frequency in the recovery operation in a second embodiment of the present invention, FIGS. 20, 21, 22, 23, 24, 25,, 26 and 27 show changes in the recording head drive frequency in the recovery operation in the present invention.

As shown in FIG. 19, in the recovery operation of the recording head, the ink is forcibly discharged from the discharge port and the frequency (F) of the drive pulse (50 V) applied to the energy generation means of the record head is changed in the range between 300 Hz and 10 kHz. As a result, air bubbles of any size in the liquid path of the record head resonate and are removed by repeatedly and continuously varying the drive frequency of the recording head as shown in FIG. 19 to forcibly suck the ink.

Figure 20:
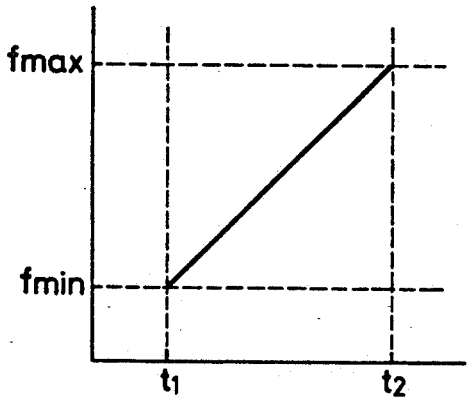
Figure 21:
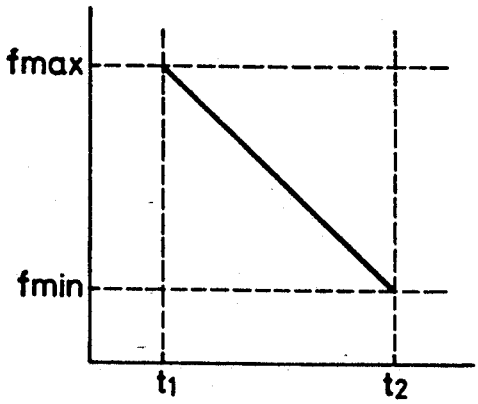
Figure 22:
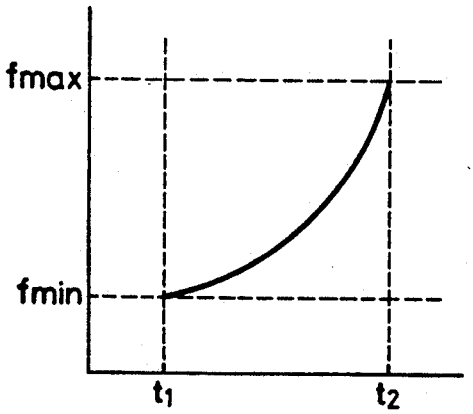
Figure 23:
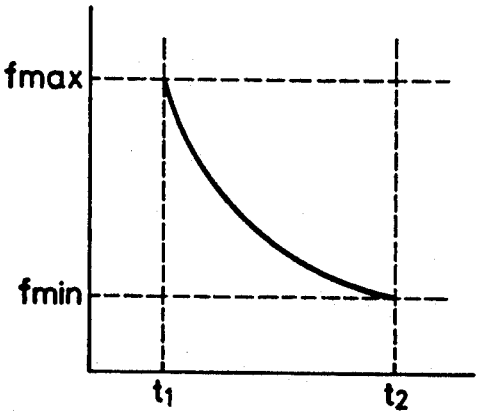
Figure 24:
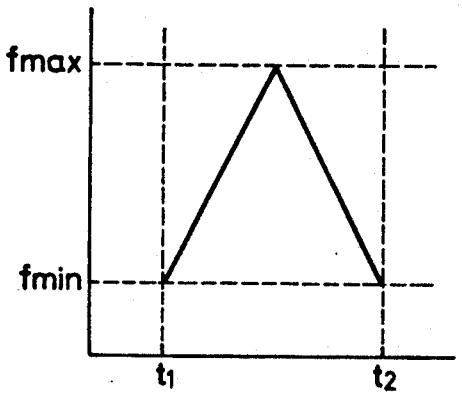
Figure 25:
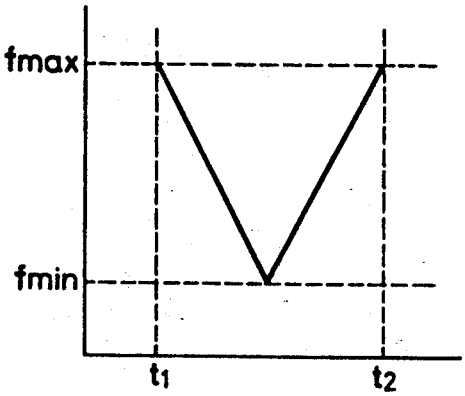
Figure 26:
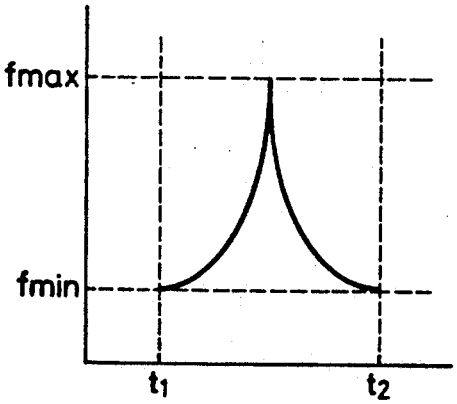
Figure 27:
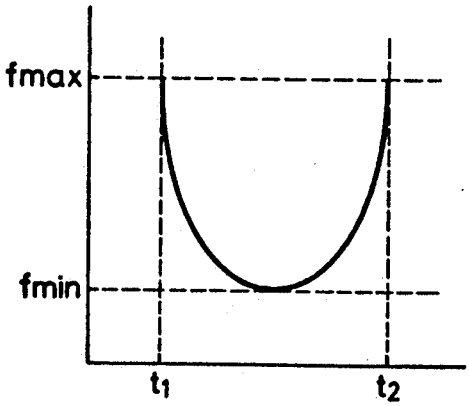

FIGS. 20 to 27 show other examples for varying the frequency of the drive pulse. For example, as shown in FIGS. 20(*a*) and 20(*b*), the drive is started from a low frequency and the frequency is gradually increased to sequentially match to resonance frequencies of the fine air bubbles. An upper limit fmax of the frequency is preferably that which does not adversely affect to the head (for example, does not cause break in the piezoelectric element which is the energy generating means), e.g., 10 kHz. A lower limit fmin of the frequency is preferably that which effectively causes the resonation of the air bubbles in the liquid path, e.g., 300 Hz.

The time period $|t_2-t_1|$ during which the drive frequency is varied as shown in FIGS. 20~27 may be preferably 0.5~3 seconds. By repeating the change of the frequency once to several times in the time period $|t_2-t_1|$, the air bubbles can be more effectively removed from the recording head.

In the present embodiment, the range of the change of the drive frequency is 300~10,000 Hz. It may be preferably 1/10~5 times of a reference drive frequency which allows normal discharge of the ink from the recording head.

Figure 28:
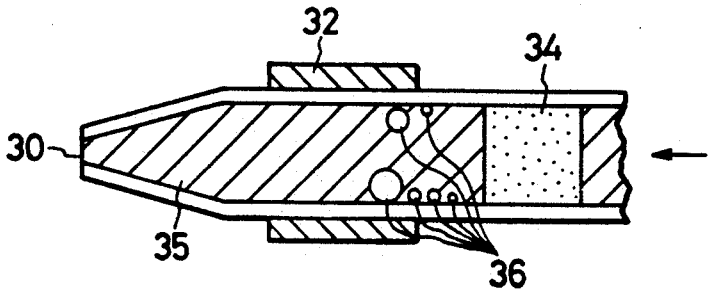
FIGS. 28, 29, 30 and 31 show air bubbles in the recording head in the misdischarge recovery operation in the present invention.
Figure 29:
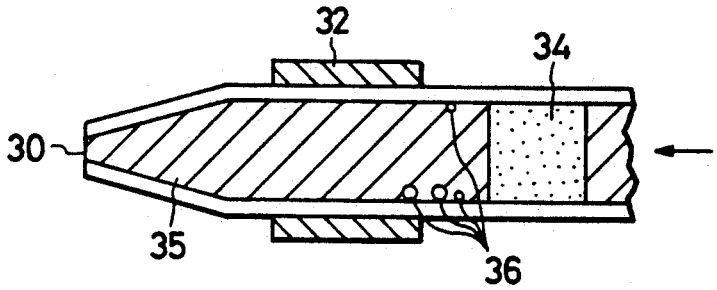
Figure 30:
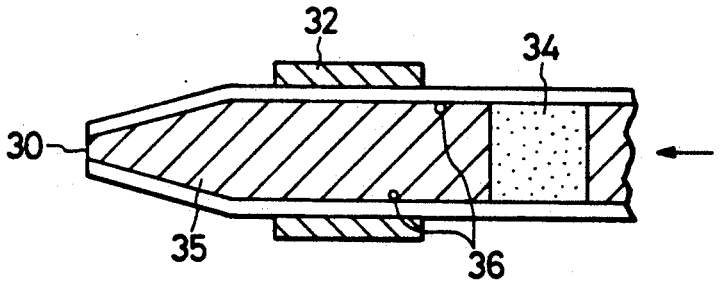
Figure 31:
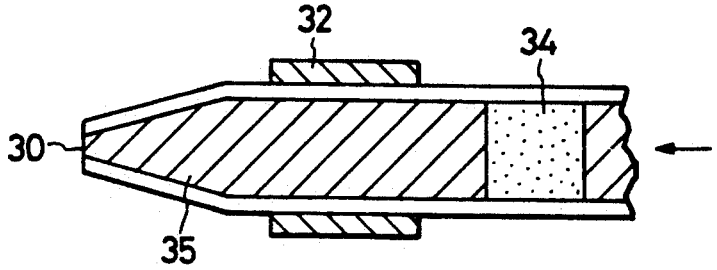

The size of the air bubbles in the liquid path of the record head includes variation, and a resonance frequency of the air bubbles in the liquid path also includes variation. On an assumption that it is more effective to drive the head at a varying frequency than at a constant frequency, the recovery of the recording head having a liquid path of 0.5 mm in inner diameter including air bubbles of different sizes is observed as shown in FIG. 28. When only the ink suction pump is used, several tens air bubbles of 10~200 μm in diameter are left in the liquid path as shown in FIG. 29. When the ink suction pump is activated while the record head is driven (at a constant drive frequency), only several air bubbles are left as shown in FIG. 30. By activating the ink suction pump while varying the head drive frequency, the air bubbles are completely removed as shown in FIG. 31.

In the present invention, the drive frequency is defined as a reciprocal of a time from the beginning of first transition of a drive pulse to the beginning of first transition of the next drive pulse.

By varying the drive frequency of the recording head simultaneously with varying the drive force, a better result is obtained and this method is applicable to any size of liquid path.

In the present invention, the timing of the drive of the recording head is not critical so long as the recording head is synchronously driven during the operation of the exhausting means.

For example, the exhausting means may be driven before driving the recording head and also a reverse order may be allowed.

Driving of the exhausting means is terminated before termination of driving of the recording head and also a reverse order may be allowed.

The timing signal may be not supplied only from the lowermost sensor but also from elements engaging the exhausting means, such as a cap sensor, pump driving sensor.

In the Embodiments 1 and 2, means for varying the drive signal (signal varying means) applied to the recording head during the suction operation is provided separately from the head driver, although it may be integral with the head driver or the CPU may has a corresponding function.

In the above embodiments, suction means for sucking the ink from the discharge port through the cap is provided as the exhaust means to discharge the ink in the recording head. Alternatively, it may be effected by pressurizing means for pressurizing the ink by a pump arranged on an ink supply side.

The present invention is applicable to any ink jet recorder which records by discharging ink to a recording plane, whatever configuration and recording system are. It is applicable not only to the ink jet recorders shown in the embodiments but also to a full-multiple type recorder in which recording heads are arranged over an entire width of the record sheet. The discharge energy generation means is not limited to the electromechanical transducer but an ink jet recorder which uses an electro-thermal transducer as shown in FIG. 32 may be used.

Figure 32:
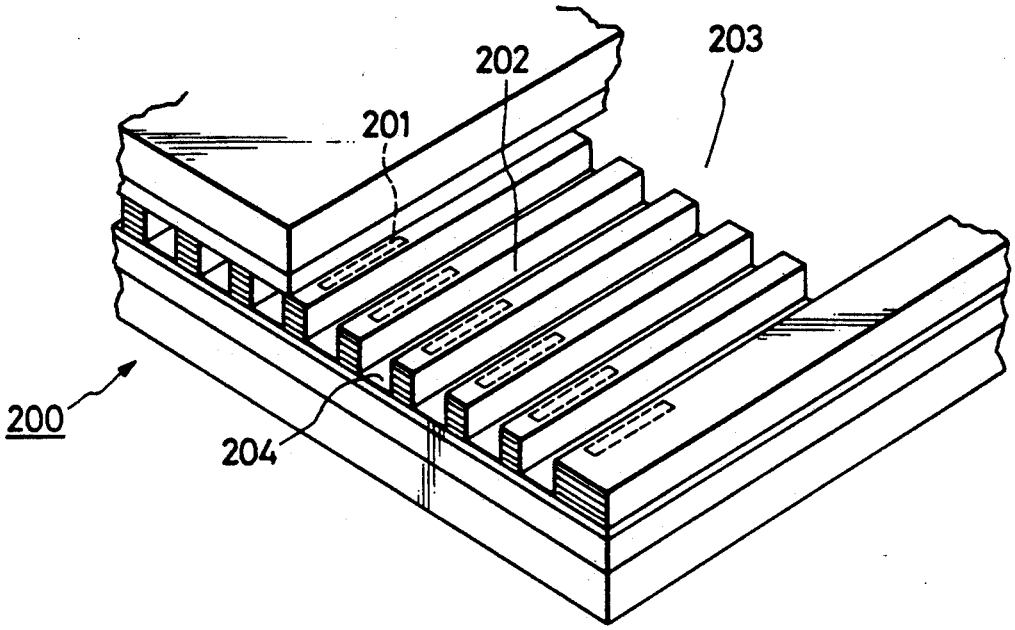
FIG. 32 shows a schematic developed view of another embodiment of the recording head of the present invention.

FIG. 32 shows a full-multiple type recording head 200 which uses an electro-thermal transducer. Numeral 201 denotes the electro-thermal transducer which is energy generating means for generating an energy to be used for discharging the ink, numeral 202 denotes a liquid path, numeral 203 denotes a common liquid chamber, and numeral 204 denotes a discharge port.

Figure 33:
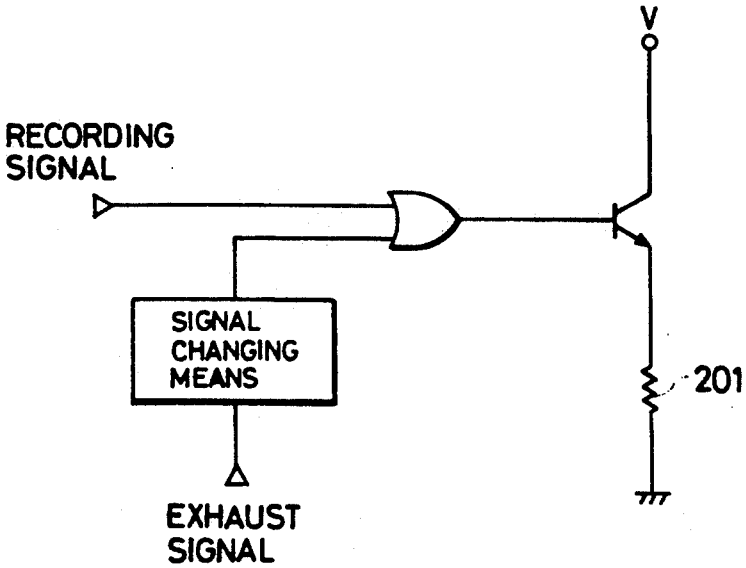
FIG. 33 shows a drive circuit for recording head as shown in FIG. 32.

FIG. 33 shows a schematic drive circuit for the head shown in FIG. 32. In this circuit, a drive signal for driving the electro-thermal transducer 201 varies in response to a capping signal and a signal for recovery operation. In this arrangement, the recording head may be driven during ink exhausting operation.

In accordance with the present invention, means for forcibly exhausting the ink in the recording head and the recording head are simultaneously driven and the ink is forcibly discharged while the drive force of the recording head is varied and/or the drive frequency of the recording head is varied. Accordingly, the air bubbles and dusts of any size in the head are effectively removed and the optimum discharge condition is achieved under any environmental condition or recording condition. Thus, the safety, continuous recording durability and image recording quality of the ink jet recorder are significantly enhanced.

What is claimed is:

1. A method for recovering discharge of ink, the method including the steps of:

providing an ink jet recording apparatus comprising a recording head having a discharge port for discharging ink, an ink path communicating with said discharge port, an energy generating member cooperating with said ink path so as to generate energy for discharging ink in response to a recording drive signal having a reference frequency providing normal ink discharge for recording, and suction means for sucking ink from said discharge port when said suction means is driven;

driving said recording head for recovery thereof by applying to said energy generating member while driving said suction means a continuously varying recovery drive signal with a frequency 1/10 to 5 times larger than the reference frequency; and activating the recovery drive signal in response to the drive of said suction means, wherein the recovery drive signal is varied continuously in a single recovery operation so that bubbles of different sizes in said ink path can be eliminated in said single recovery operation.

2. An ink jet recovery apparatus for recovering ink discharge from an ink jet recorder that discharges ink from a discharge port of a recording head and has energy generating means for generating energy in response to a recording drive signal having a reference frequency providing normal ink discharge from the discharge port for recording, said apparatus comprising:

exhausting means for exhausting ink from the recording head, wherein said exhausting means includes suction means for sucking ink from the ink discharge port by a suction force when said exhausting means is driven;

drive means for applying to the energy generating means a continuously varying recovery drive signal with a frequency 1/10 to 5 times larger than the reference frequency to drive the recording head for recovery thereof in response to the drive of said exhausting means; and signal varying means for continuously varying the recovery drive signal applied to the energy generating means while said exhausting means is driven, said signal varying means being activated by the drive of said exhausting means, wherein the recovery drive signal is varied continuously in a single recovery operation so that bubbles of different sizes in an ink path can be eliminated in said single recovery operation.

3. An ink jet recovery apparatus according to claim 2, wherein said signal varying means continuously varies a voltage of the drive signal.

4. An ink jet recovery apparatus according to claim 3, wherein said voltage continuously varies between 30 V and 80 V.

5. An ink jet recovery apparatus according to claim 2, wherein said signal varying means continuously varies a pulse width of the drive signal.

6. An ink jet recovery apparatus according to claim 5, wherein said pulse width continuously varies between 5 μsec and 30 μsec.

7. An ink jet recovery apparatus according to claim 2, wherein said signal varying means varies a frequency of the drive signal.

8. An ink jet recovery apparatus according to claim 7, wherein said frequency continuously varies between 300 Hz and 10 KHz.

9. An ink jet recovery apparatus according to claim 2, wherein said suction means includes a cap for covering the discharge port and a suction pump for sucking ink through the cap.

10. An ink jet recovery apparatus according to claim 2, wherein the drive timing of said exhausting means is synchronized with the timing of the drive signal of said energy generating means.

11. An ink jet recovery apparatus according to claim 2, wherein said energy generating means includes an electro-mechanical transducer.

12. An ink jet recovery apparatus according to claim 2, wherein said energy generating means includes an electro-thermal transducer.

13. An ink jet recovery apparatus according to claim 2, wherein said recording head is a full-multiple type head.

14. An ink jet recovery apparatus according to claim 2, wherein said signal varying means is activated when said exhausting means creates a maximum suction force for sucking ink from the ink discharge port.

15. An ink jet recording apparatus comprising:

a recording head having a discharge port for discharging ink, an ink path communicating with said discharge port and energy generating means provided in said ink path so as to generate energy for discharging ink in response to a recording drive signal having a reference frequency providing normal ink discharge for recording;

driving means for applying to said energy generating means a continuously varying recovery drive signal with a frequency 1/10 to 5 times larger than the reference frequency for recovery of said recording head;

exhausting means for exhausting ink in said ink path when said exhausting means is driven during a non-operation period; and detecting means for detecting drive of said exhausting means, wherein said driving means is driven in response to a detection signal generated by said detecting means, the recovery drive signal is varied continuously during drive of said exhausting means, and the recovery drive signal is varied continuously in a single recovery operation so that bubbles of different sizes in said ink path can be eliminated in said single recovery operation.

16. An ink jet recording apparatus comprising:

a recording head having a discharge port for discharging ink, an ink path communicating with said discharge port and energy generating means provided in said ink path so as to generate energy for discharging ink in response to a recording drive signal having a reference frequency providing normal ink discharge for recording;

exhausting means for exhausting ink from the recording head, wherein said exhausting means includes suction means for sucking ink from the ink discharge port by a suction force when said exhausting means is driven;

drive means for applying to the energy generating means a continuously varying recovery drive signal with a frequency 1/10 to 5 times larger than the reference frequency to drive the recording head for recovery thereof in response to the drive of said exhausting means; and signal varying means for continuously varying the recovery drive signal applied to the energy generating means while said exhausting means is driven, with said signal varying means being activated by the drive of said exhausting means, wherein the recovery drive signal is varied continuously in a single recovery operation so that bubbles of different sizes in said ink path can be eliminated in said single recovery operation.

17. An ink jet recovery apparatus for recovering ink discharge from an ink jet recorder that discharges ink from a discharge port of a recording head and has energy generating means for generating energy in response to a recording drive signal having a reference frequency providing normal ink discharge from the discharge port for recording, said apparatus comprising:

driving means for applying to the energy generating means a continuously varying recovery drive signal with a frequency 1/10 to 5 times larger than the reference frequency for recovery of the recording head to said energy generating means;

exhausting means for exhausting ink in said ink path when said exhausting means is driven during a non-operation period; and detecting means for detecting means of said exhausting means, wherein said driving means is driven in response to a detection signal generated by said detection means and the recovery drive signal is varied continuously during drive of said exhausting means, and the recovery drive signal is varied continuously in a single recovery operation so that bubbles of different sizes in an ink path can be eliminated in said single recovery operation.

18. An ink jet recovery apparatus according to claim 17, wherein the voltage of the drive signal applied by said driving means is continuously varied.

19. An ink jet recovery apparatus according to claim 18, wherein said voltage continuously varies between 30 V and 80 V.

20. An ink jet recovery apparatus according to claim 17, wherein the pulse width of the drive signal applied by said driving means is continuously varied.

21. An ink jet recovery apparatus according to claim 20, wherein said pulse width varies between 5 μsec. and 30 μsec.

22. An ink jet recovery apparatus according to claim 17, wherein the frequency of the drive signal applied by said driving means is continuously varied.

23. An ink jet recovery apparatus according to claim 22, wherein said frequency continuously varies between 300 Hz and 10 Khz.

24. An ink jet recovery apparatus according to claim 17, wherein said suction means includes a cap for covering the discharge port and a suction pump for sucking ink through the cap.

25. An ink jet recovery apparatus according to claim 17, wherein the drive timing of said exhausting means is synchronized with the timing of the drive signal of said energy generating means.

26. An ink jet recovery apparatus according to claim 17, wherein said energy generating means includes an electro-mechanical transducer.

27. An ink jet recovery apparatus according to claim 17, wherein said energy generating means includes an electro-thermal transducer.

28. An ink jet recovery apparatus according to claim 17, wherein said recording head is a full-multiple type head.

29. An ink jet recovery apparatus according to claim 17, wherein the continuously varying drive signal applied by said driving means is applied when said exhausting means creates a maximum suction force for sucking ink from the ink discharge port.

* * * * *

UNITED STATES PATENT AND TRADEMARK OFFICE

CERTIFICATE OF CORRECTION

PATENT NO. : 5,298,923

DATED : March 29, 1994

INVENTOR(S) : TATSUYUKI TOKUNAGA, et al

It is certified that error appears in the above-indentified patent and that said Letters Patent is hereby corrected as shown below:

COLUMN 1

Line 6, "continuation-in-part" should read --continuation--.
Line 14, "is" should read --in--.
Line 21, "an" should read --a--.
Line 44, "disclosed" should read --discloses--.

COLUMN 2

Line 39, "a" should read --an--.

COLUMN 3

Line 35, "plurality" should read --plurality of--.

COLUMN 5

Line 39, "wee" should read --were--.

COLUMN 6

Line 17, "to" should be deleted.

COLUMN 7

Line 9, "has" should read --have--.
Line 47, "dusts" should read --dust--.

COLUMN 8

Line 50, "varies" should read --continuously varies--.

UNITED STATES PATENT AND TRADEMARK OFFICE

CERTIFICATE OF CORRECTION

PATENT NO. : 5,298,923

DATED : March 29, 1994

INVENTOR(S) : TATSUYUKI TOKUNAGA, ET AL

It is certified that error appears in the above-indentified patent and that said Letters Patent is hereby corrected as shown below:

COLUMN 10

Line 14, "means" (second occurrence) should read --drive--.

Signed and Sealed this

Sixth Day of September, 1994

*Attest:*

Bruce Lehman

BRUCE LEHMAN

*Attesting Officer*

*Commissioner of Patents and Trademarks*